6/12/84 XR 4,453,487

United States Patent [19]

Vinnari

[11] 4,453,487

[45] Jun. 12, 1984

[54] DEVICE FOR FASTENING TWO HULLS TO EACH OTHER

[76] Inventor: Risto Vinnari, P.O. Box 15, SF 20311 Turku 31, Finland

[21] Appl. No.: 363,106

[22] Filed: Mar. 29, 1982

[30] Foreign Application Priority Data

Aug. 13, 1980 [FI] Finland ..... 802546

[51] Int. Cl.[3] ..... B63B 21/56

[52] U.S. Cl. ..... 114/249; 114/242; 114/246

[58] Field of Search ..... 114/242, 246, 249, 250; 280/458, 460 R, 461 R, 497

[56] References Cited

U.S. PATENT DOCUMENTS

| | | | |
|---|---|---|---|
| 1,263,622 | 4/1918 | Sutton | 280/460 R |
| 3,035,537 | 5/1962 | Smith | 114/246 |
| 3,461,829 | 8/1969 | Mosvold | 114/246 |
| 4,127,202 | 11/1978 | Jennings | 280/458 |
| 4,249,324 | 2/1981 | Latimer | 114/246 |

FOREIGN PATENT DOCUMENTS

| | | | |
|---|---|---|---|
| 1247972 | 10/1960 | France | 114/249 |
| 486945 | 6/1973 | U.S.S.R. | 114/242 |

*Primary Examiner*—Trygve M. Blix
*Assistant Examiner*—Rodney Corl
*Attorney, Agent, or Firm*—Wood, Dalton, Phillips, Mason & Rowe

[57] ABSTRACT

Disclosed is a device for fastening two hulls to each other, one of the hulls usually being a motor hull and the other a cargo hull. The device includes a first pair of booms (1,2) extending essentially parallel to each other between the hulls (5,6) and at least one further boom, preferably one further pair of booms (3,4) extending, as seen from one side, crosswise in relation to the first pair of booms (1,2) so that all the booms (1,2; 3,4), seen from the side, constitute the diagonals of a quadrangle determined by the fastening points of the booms. Preferably, the booms are fastened to the hulls by means of transversal bars (8,9) mounted pivotably in horizontal planes on the hulls. At least two of the booms are preferably adjustable as to their length.

8 Claims, 4 Drawing Figures

DEVICE FOR FASTENING TWO HULLS TO EACH OTHER

TECHNICAL FIELD

The present invention relates to a device for fastening two hulls to each other. In particular, it relates to a device including a pair of booms, attached to the hulls preferably by transverse bars, and eventual steering means for turning of the hulls in relation to each other in the horizontal plane.

BACKGROUND ART

The most common solutions known in the art are devices which are provided with either one or several booms and by means of which only a stationary attachement between two hulls is usually achieved. The said booms are in a normal case on the same plane, and consequently, the movement of one hull is transmitted to the other hull in only a certain direction. The most conventional solutions in the art are those in which the booms are articulated to the hull via a horizontal axle journal, or ball joints can also be used.

As is evident from the above, the devices known in the art have the disadvantage that by means of them it is possible to coordinate the movements between two hulls to each other to a very limited degree, usually in only one direction. It can also be regarded as a disadvantage in the said devices that by means of them it is not possible to adjust the draught between the hulls in any way, and neither is it possible to steer one hull by means of the other.

DISCLOSURE OF INVENTION

The object of the present invention is to eliminate the deficiencies in the current state of the art, as disclosed above. For this purpose, the invention provides a device of the character once described, which comprises at least one further boom, preferably one pair of further booms extending, as seen from one side, crosswise in relation to the first pair of booms so that the first and second booms constitute, as seen from the side, the diagonals of a quadrangle formed by their fastening points. Thus, it is provided a device by means of which the movements of the hulls are smoothed out in relation to each other. By means of the device according to the invention it is also possible to adjust the difference in draught between the hulls to a certain level and to maintain it at a certain value or, when so desired, also alter the difference in draught. A further object of the device according to the invention is to achieve a controlled steering action.

BEST MODE FOR CARRYING OUT THE INVENTION

Figure 1:
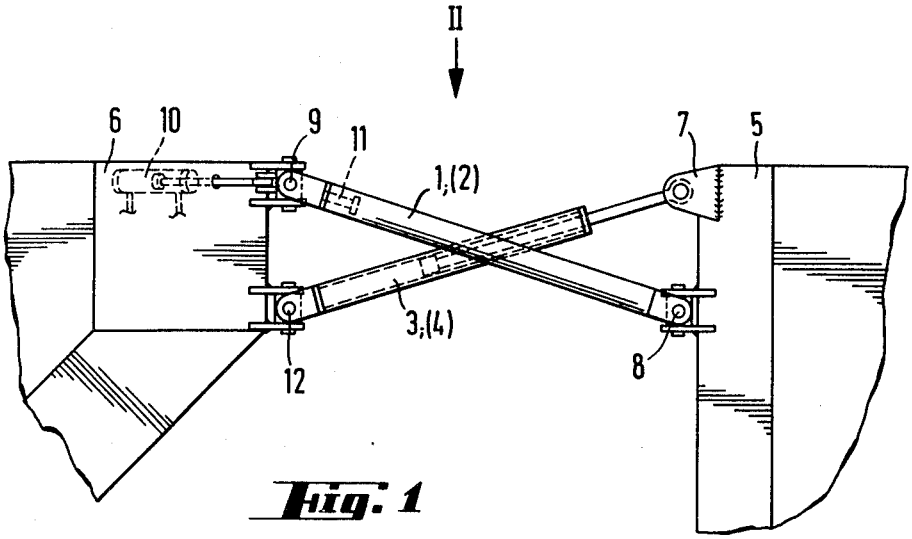
FIG. 1 depicts a side view of one preferred embodiment of the device.
Figure 2:
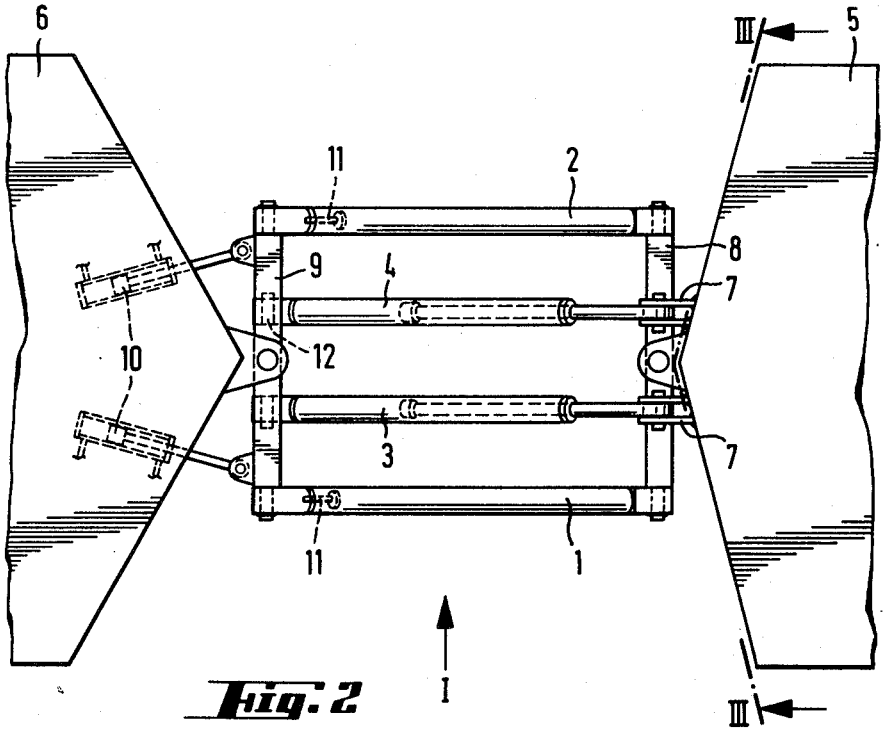
FIG. 2 depicts a top view of the same device.
Figure 3:
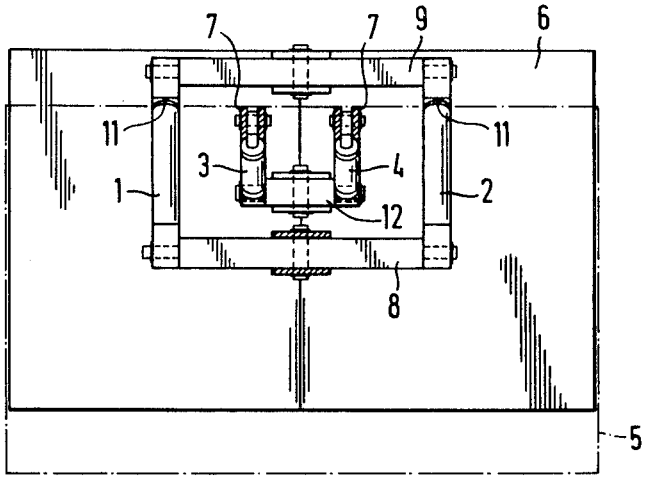
FIG. 3 depicts the same device as seen along the longitudinal axis of the hulls.

The device advantageously comprises four booms 1, 2, 3, and 4, even though a three-boom system is practicable. The booms constitute, as seen from the side, the diagonals of a quadrangle formed by its fastening points. One diagonal consists of booms 1 and 2, which are mutually parallel, and the other diagonal of booms 3 and 4, which are also mutually parallel. In this preferred embodiment, the booms 3 and 4 are provided with means which enable them to be lengthened and shortened, the means preferably being double-acting hydraulic cylinders. The booms 3 and 4 are attached at one end to the hull 5 by means of fixed lugs 7 and at the other end to the hull 6 by means of a horizontal bar 12. The booms 1 and 2, for their part, are fastened to the hull 5 by means of a horizontal bar 8 and to the hull 6 by means of a horizontal bar 9. All the horizontal bars 8, 9 and 12 are articulated to the hulls by means of vertical axle trunnions. The sytem also includes members 10 by means of which the steering of the hulls is effected. The members 10 are preferably double-acting hydraulic cylinders, even though a single-acting hydraulic cylinder or other similar device is also suitable for the purpose. Booms 1 and 2 have, in addition, a point, indicated by 11, which allows the ends of the booms to turn in relation to each other. The device making such turning possible is, for example, a swivel-type device, known in navigation.

Figure 4:
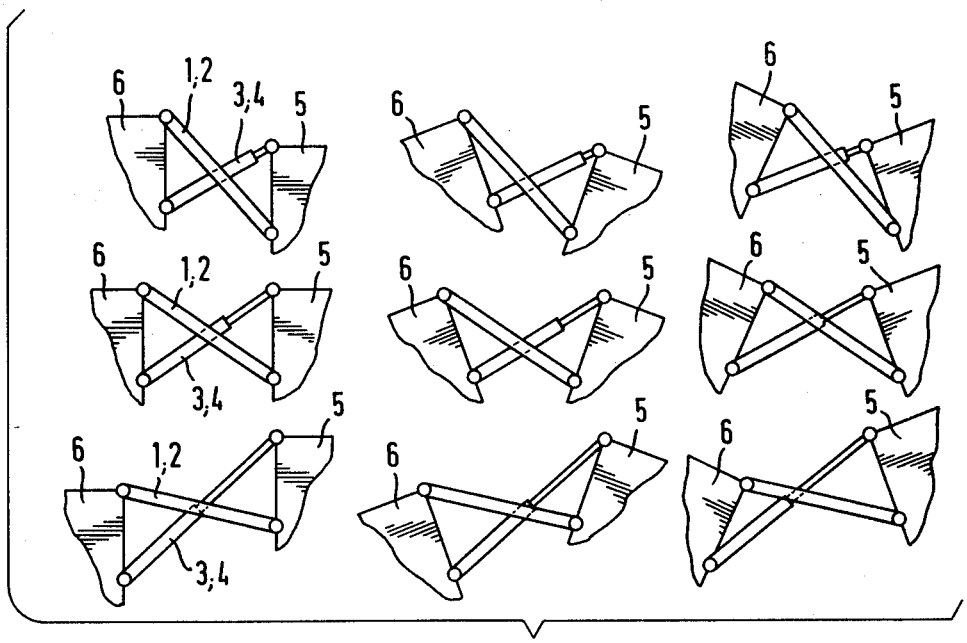
FIG. 4 depicts a schematic side view of the behavior of the device in rough sea, the hulls being in three different draught positions.

The system works as follows: If the device is used for fastening to each other two hulls, of which the hull 6 is preferably the motor hull and the hull 5 the cargo hull, changes occur in the draught in relation to the hulls when the cargo hull is loaded. In this case, the booms 3 and 4 are set, with the aid of their means enabling the shortening and lengthening of the booms to be carried out, to comply with the changes in the draught of the hulls. When the loading has been completed, the booms 3 and 4 are made rigid in a position in which the hulls 5 and 6 are in an almost tension-free state in relation to each other. Thereafter the motor hull 6 can be used to push or respectively pull the hull 5 to the desired place. The steering action is produced by lengthening one of the members 10 and by shortening respectively the other, whereby the direction of the longitudinal axes of the hulls is changed. Since the booms are crosswise as seen from the side, the movements of the hulls are thus completely coordinated with each other. The coordination in this case means that the movements created in the hulls by rough sea are smoothed out by the system according to the invention. The movements created in the hulls by rough sea are illustrated in FIG. 4. It is, of course, evident that tilts of the hulls in relation to each other are allowed by the device. For this reason, the booms 8, 9, and 12 tilt along with the hulls and the booms comply with the tilt, i.e. members 11 allow the boom ends to turn in relation to each other.

It is possible to use several variants of the device. One such variant is one in which all the booms 1–4 have adjustable lengths. This advantageously means that all the booms have hydraulic cylinders. In this case, the distances of the booms from each other can be adjusted when desired, which may provide certain advantages in navigation. In principle, the system can also be used without the steering action, in which case the members 10 are unnecessary and the booms 1 and 2 are fastened to the hull 6 by means of fixed lugs. However, hydraulic cylinders are not necessarily required for adjusting the length of the booms, but ordinary manually operated screw-threaded devices can well be applied to the adjustment of the length.

In practice, it is advantageous that most of the various parts of the system are coupled to the motor hull. In this case, the hulls are fastened to each other advantageously by bringing the motor hull with the device coupled to it close to the cargo hull and by fastening it to the latter. The motor hull 6 must, of course, have members by means of which the entire device can be supported in a certain position when the device is not coupled to the other hull. The device can also be used in such a manner that several cargo hulls are coupled to one motor hull, in which case there is a separate device according to the invention for each of the cargo hulls.

As to the connecting booms, it is evident that in some cases a pair of booms can mean just one fork-shaped boom having only one fastening point in the single-arm end.

INDUSTRIAL APPLICABILITY

The invented device can be applied for interconnecting nearly all kinds of vessels to each other, although the general application is to attach a pusher tug to a barge. The device can operate also in rough sea, where the boom link system serves to smoothen movements of the hulls in relation to each other.

I claim:

1. A device for fastening the hulls of two vesels, one of which is usually a motorized vessel and the other of which is usually a cargo carrying vessel, to each other, comprising:

a pair of booms formed of rigid elements attached to said hulls by means including transverse bars, steering means for turning the hulls with respect to each other in a horizontal plane, and at least one additional boom formed of a rigid element extending crosswise in relation to said first pair of booms as projected on a vertical plane, means connecting said additional boom between said hulls, said booms, as projected on said vertical plane, defining the diagonals of a quadrangle formed by their attaching points to said hulls.

2. The device of claim 1 wherein the rigid element forming said additional boom has an adjustable length.

3. The fastening device of claim 1 wherein said steering means includes power operated means for turning one hull with respect to the other hull in a horizontal plane.

4. The fastening device of claim 1 wherein there are two said additional booms and said device is made up of four said booms.

5. The fastening device of claim 2 wherein each of said rigid elements is of adjustable length.

6. A fastening device according to any of the preceding claims wherein said booms include hydraulic cylinders to provide length adjustment thereof and said steering means comprise hydraulic cylinders.

7. A fastening device according to claim 6 wherein said hydraulic cylinders are double acting.

8. The fastening device of claim 1 wherein the booms of said pair are parallel to each other and wherein there are two of said additional booms, said additional booms being parallel to each other.

* * * * *